US006237812B1

(12) United States Patent
Fukada

(10) Patent No.: US 6,237,812 B1
(45) Date of Patent: May 29, 2001

(54) AEROSOL DISPENSING SYSTEM

(75) Inventor: Rokuro Fukada, Otsu Shiga (JP)

(73) Assignee: Eiko-Sha Co. Ltd., Kyoto (JP)

( * ) Notice: Subject to any disclaimer, the term of this patent is extended or adjusted under 35 U.S.C. 154(b) by 0 days.

(21) Appl. No.: 09/415,931

(22) Filed: Oct. 12, 1999

(51) Int. Cl.[7] ..... B67D 5/06

(52) U.S. Cl. ..... 222/181.2; 222/402.12; 222/402.13

(58) Field of Search ..... 222/74, 181.3, 222/181.2, 402.1, 402.15, 402.21, 325, 180, 402.13

(56) References Cited

U.S. PATENT DOCUMENTS

| | | | | |
|---|---|---|---|---|
| 2,376,404 | | 5/1945 | Thoms | 222/400 |
| 2,602,700 | * | 7/1952 | Ryan | 299/95 |
| 2,726,016 | | 12/1955 | Anderson | 222/127 |
| 2,942,631 | | 6/1960 | Biewald | 141/360 |
| 3,007,613 | | 11/1961 | Tygard | 222/394 |
| 3,045,873 | * | 7/1962 | Ryan | 222/162 |
| 3,549,049 | | 12/1970 | Weber | 222/91 |
| 3,661,300 | * | 5/1972 | Nigro | 222/80 |
| 3,972,447 | | 8/1976 | Fegley | 222/5 |
| 4,089,440 | | 5/1978 | Lee | 222/174 |
| 4,111,338 | | 9/1978 | Cheng et al. | 222/180 |
| 4,223,812 | * | 9/1980 | Van Lit | 222/180 |
| 4,550,865 | * | 11/1985 | Hirao et al. | 222/402.21 |
| 4,670,916 | | 6/1987 | Bloom | 4/231 |
| 4,971,257 | | 11/1990 | Birge | 239/708 |
| 5,082,149 | * | 1/1992 | Cross | 222/162 |
| 5,316,185 | | 5/1994 | Meenan | 222/321 |

(List continued on next page.)

FOREIGN PATENT DOCUMENTS

| | | | |
|---|---|---|---|
| 2659630 | * | 3/1990 | (FR) . |
| 8-502431 | | 3/1996 | (JP) . |
| 9-75431 | | 3/1997 | (JP) . |

*Primary Examiner*—Joseph A. Kaufman
*Assistant Examiner*—Melvin A. Cartagena
(74) *Attorney, Agent, or Firm*—Workman, Nydegger & Seeley

(57) ABSTRACT

The present invention discloses an aerosol dispensing device for selectively dispensing a pressurized aerosol disinfectant from an aerosol container. A wall mounted support base for holding an aerosol container has two support holes at its lower end which rotatingly receive corresponding support shafts integral with a cover so as to permit the cover to rotate downward with respect to the support base; a latch mechanism detachably secures the top end of the cover to the support base. The aerosol container includes a normally closed discharge valve at one end, the discharge valve having a hollow stem extending from one end of the aerosol container and being in flow communication therewith when the hollow stem is laterally deflected. The aerosol container is removably received, stem down, in a mating U-shaped support arm attached to the support base, by means of a mating ring-form groove formed in one end of the aerosol container near the hollow stem. A supplemental nozzle with integral extender projection is removably attached to the hollow stem so as to form a discharge flow path therewith when the discharge valve is open; the extender projection normally reposing in a first position wherein the hollow stem is undeflected and the discharge valve is closed. The aerosol dispensing device is activated by means of an actuating force applied to a pushbutton suspended in a cut-out area of the cover; the pushbutton being rotatingly attached to the cover by two suspension arms. An actuator integral with the pushbutton laterally displaces the extender projection to a second position wherein the discharge valve is open, in response to the actuating force. Two resilient members integral with the pushbutton, and compressed in accordance with the actuating force, act to resist motion of the pushbutton and permit the extender projection to be automatically restored to the first position when the actuating force ceases to be applied to the pushbutton.

14 Claims, 5 Drawing Sheets

U.S. PATENT DOCUMENTS

| | | | |
|---|---|---|---|
| 5,732,853 | 3/1998 | Ganzeboom et al. | 222/82 |
| 5,862,960 | 1/1999 | Miller et al. | 222/325 |
| 5,875,934 | 3/1999 | Miller et al. | 222/183 |
| 5,904,273 | 5/1999 | Aspacher et al. | 222/402.15 |
| 5,906,299 | 5/1999 | Hagleitner | 222/190 |
| 5,915,599 * | 1/1999 | Takahashi | 222/402.13 |

* cited by examiner

AEROSOL DISPENSING SYSTEM

BACKGROUND OF THE INVENTION

1. The Field of the Invention

Embodiments of the present invention relate to an improved aerosol dispensing system for selectively dispensing a disinfecting agent from an aerosol container.

2. The Prior State of the Art

There has been an increasing emphasis on the need for improved hygiene as a means to substantially reduce and/or prevent the incidence of illness and disease. Areas where improved hygiene is particularly critical include food processing plants, eating and drinking establishments, convenience stores and hospitals. In an effort to improve hygiene, a variety of disinfectant systems have been devised. As indicated in the following discussion however, known disinfectant systems suffer from a variety of shortcomings which make those systems at least inconvenient to use and which, in more extreme cases, may actually impede the ability of those systems to reduce the incidence of illness and disease.

At least one known disinfecting system requires complete immersion of the user's hands in a disinfecting solution; thereafter, the user's hands are rinsed and dried off with a towel. While relatively simple, this system is somewhat inconvenient because it requires at least three steps; immersion, rinsing, and drying. Further, where several users utilize the same towel, the towel may actually impede the effectiveness of the system; common use of the same drying towel increases the likelihood that disease-causing germs and the like will be transferred to the towel and thence to other users.

Recently, pump-type disinfecting devices have been devised which emit an alcohol type disinfectant in the form of a mist when the head of the pump is directly depressed with the hands. These devices are often employed in hospitals. Pump-type devices are arguably more effective than the immersion method because the pump-type devices do not require the rinsing and drying steps that are characteristic of the immersion disinfection systems. Furthermore, the effectiveness of the pump-type disinfecting device is enhanced by the fact that no towels are required; as previously noted, the use of towels in conjunction with a disinfection system may actually impede the effectiveness of the system.

Although pump-type disinfecting devices represent some improvement over the immersion disinfecting system, the pump-type disinfecting devices are problematic as well. In particular, the entire disinfecting device must be replaced, or else the pump must be removed and disinfectant added to the vessel of the disinfecting device, whenever the disinfectant runs out. In view of the labor-intensive maintenance/service required by such devices, they are not suitable for locations where they would be heavily used.

Other disinfecting devices have been designed which are more suitable for heavy use. In one known device, a disinfectant tank and a pump are installed on the left and right of the rear portion of the main body, and the disinfectant liquid inside the tank is drawn upward by means of the pump and caused to jet from a spray nozzle located on the front upper portion of the device. This device has a configuration in which a cover equipped with an opening into which the user's hands are inserted is installed on the front surface of the device. In cases where the tank is constructed as a cartridge type tank, this device is convenient to use.

However, this device is undesirably complicated and expensive due to the numerous pieces and types of equipment/parts employed.

Another known spray type disinfecting device consists of a support base and a cover that can be fastened to a wall surface. This device is configured with a separate spray mechanism having a nozzle at its lower end, a pump, and a connecting pipe at the upper end. An actuating lever is installed in a position on the cover in operative relation with the pump. A pouch containing a disinfectant solution is held between the support base and the cover in a state in which a coupling means installed in the pouch is inserted into the connecting pipe of the spray mechanism.

While somewhat responsive to the problems previously noted, this disinfecting device suffers from at least two significant deficiencies. First, the connecting pipe of the spray mechanism must be inserted into the coupling means of the pouch each time that the pouch is replaced. Furthermore, since no means for the stable retention of the pouch between the support base and the cover is provided, the pouch cannot be stably held.

In addition to the need for a device for disinfecting a user's hands, there often is the need to disinfect and clean the various facilities utilized by a user, especially, for example, in a public restroom-type environment. For example, in a public restroom, a user may wish to clean, or otherwise sanitize, a toilet seat prior to use. Other surfaces, such as countertops or diaper-changing stations, may also require sanitization by the user. However, existing disinfectant dispensing devices do not provide the type of dispensing arrangement that would allow a user to do this in a quick, easy and satisfactory manner.

In view of the foregoing problems with known disinfecting devices such as aerosol disinfectant containers and aerosol disinfectant dispensers, what is needed is an improved aerosol dispensing device and system for use with pressurized disinfecting agents. The aerosol dispensing device and system should be convenient to use and should minimize the number of steps required to disinfect a user's hands, or to disinfect other facilities, such as a toilet seat surface. Further, the aerosol dispensing device should be mechanically simple and easy to maintain and should facilitate ready replenishment of the disinfecting agent. Additionally, the aerosol dispensing device should be inexpensive to produce. Finally, the container holder should stably and removably secure the aerosol disinfectant container.

SUMMARY AND OBJECTS OF THE INVENTION

The present invention has been developed in response to the current state of the art, and in particular, in response to these and other problems and needs that have not been fully or completely solved by currently available aerosol dispensing systems. Thus, it is an overall object of the present invention to provide an aerosol dispensing device and system that is easy to use and maintain and that is particularly useful in selectively dispensing disinfecting agents and the like from a standard aerosol can having a tilting stem discharge valve. It is another object of the present invention to provide an aerosol dispensing device that may be wall mounted so that it can be conveniently located for access by a user. It is another object of the present invention to provide an aerosol dispensing device that sprays disinfectant in aerosol form directly onto a user's hands, or onto a tissue or the like for application to a surface to be disinfected, so as to preclude the need for rinsing and/or drying of the user's hands after application of the disinfectant. It is also an object of the present invention to provide an aerosol dispensing device that employs an integral actuation and restoration mechanism calculated to improve ease of use while simultaneously minimizing mechanical complexity and expense. More particularly, it is an object of the present invention to provide an aerosol dispensing device which employs a pushbutton having an integral actuator to cause disinfectant to be discharged from the aerosol container. Another object of the present invention to provide an aerosol dispensing system that can be used in conjunction with replaceable aerosol containers. It is also an object of the present invention to provide an aerosol dispensing device that can discharge disinfectant at predetermined angles for ease of use.

In summary, the foregoing and other objects, advantages and features are achieved with improved aerosol dispensing device and system for use in selectively dispensing aerosol disinfectant agents and the like onto a user's hands or tissue/cloth for application to a surface which it is desired to disinfect. Embodiments of the present invention are particularly suitable for use with aerosol containers having stem discharge valves. For instance, an aerosol container having a stem discharge valve is removably secured in the aerosol disinfectant container holder in such a way that the stem is in operative relation with the actuator. The user is then able to selectively discharge aerosol disinfectant by at least indirectly applying a force to the actuator. Such devices find particular application in public restroom facilities, and especially in facilities located in food processing plants, eating and drinking establishments, convenience stores, hospitals and the like, that require a high degree of cleanliness and sanitation.

In a preferred embodiment, the aerosol dispensing device includes a wall-mountable enclosure, that includes a support base and a hinged front cover. The support base has a support arm that removably receives a corresponding ring form groove formed in the top portion of a container. Preferably, the container is an aerosol container that holds a pressurized disinfecting agent. In preferred embodiments, the container is inverted with the top portion facing down when the aerosol container is fully received in the support arm.

The aerosol container is equipped with a discharge valve having a tilting stem, wherein lateral motion of the tilting stem causes an open flow path to be established between the interior of the aerosol container and the discharge valve, so as to permit discharge of the disinfectant agent from the aerosol container via the discharge valve. In a preferred embodiment, a supplemental nozzle is mounted about the stem of the discharge valve wherein the supplemental nozzle forms a flow path with the stem of the discharge valve so that disinfecting agent discharged from the aerosol container passes first through the stem of the discharge valve and then through the supplemental nozzle. Preferably, one end of the nozzle is sufficiently large as to receive the stem partially therein. In a preferred embodiment, an extender projection is integrally formed with the supplemental nozzle and is substantially perpendicular to the flow path established by the supplemental nozzle. Thus, lateral movement of the extender projection causes a substantially equal lateral movement of the stem of the discharge valve by virtue of the supplemental nozzle, integral with the extender projection, being mounted about the tilting stem of the discharge valve.

The aerosol dispensing device also includes means for opening and closing the discharge valve. In a preferred embodiment, the means for opening and closing the discharge valve includes a pushbutton rotatably mounted to the cover of the enclosure. The pushbutton has an actuator, preferably integral with the pushbutton, that protrudes into the interior of the enclosure so as to laterally displace the extender projection, and thus open the discharge valve when an actuating force is applied to the pushbutton. Preferably, the extender projection, and thus the supplemental nozzle, are laterally displaced in such a direction as to direct the discharge of the aerosol disinfectant away from the user. In a preferred embodiment, the support base includes a nozzle guide to constrain the motion of the supplemental nozzle and extender projection to a predetermined range and direction of motion, and thereby prevent damage to the stem of the discharge valve that could result from an extreme lateral displacement.

A restoration mechanism comprises two resilient members integral with the pushbutton and bearing on two mating surfaces integral with the support base. Preferably, the resilient members are substantially in the form of "S" shaped springs. The resilient members act to bias the pushbutton, and thus the actuator integral with the pushbutton, in a direction away from the extender projection. In this way, the extender projection is maintained in a first position when the discharge valve is closed. To move the extender projection to a second position and open the discharge valve, an actuating force sufficiently great to overcome the bias imposed on the pushbutton by the resilient members must be applied to the pushbutton.

These and other objects, features, and advantages of the present invention will become more fully apparent from the following description and appended claims, of may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention and its presently understood best mode for making and using the same will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations.

It is to be understood that the drawings are diagrammatic and schematic representations of presently preferred embodiments of the invention, and are not to be construed as limiting the present invention, nor are the drawings necessarily drawn to any particular scale.

In general, embodiments of the present invention relate to an aerosol dispensing device and system for use in selectively dispensing a disinfectant agent from an aerosol container. FIGS. 1 through 6 indicate various presently preferred embodiments of an aerosol dispensing device conforming to the teachings of the invention.

Figure 1:
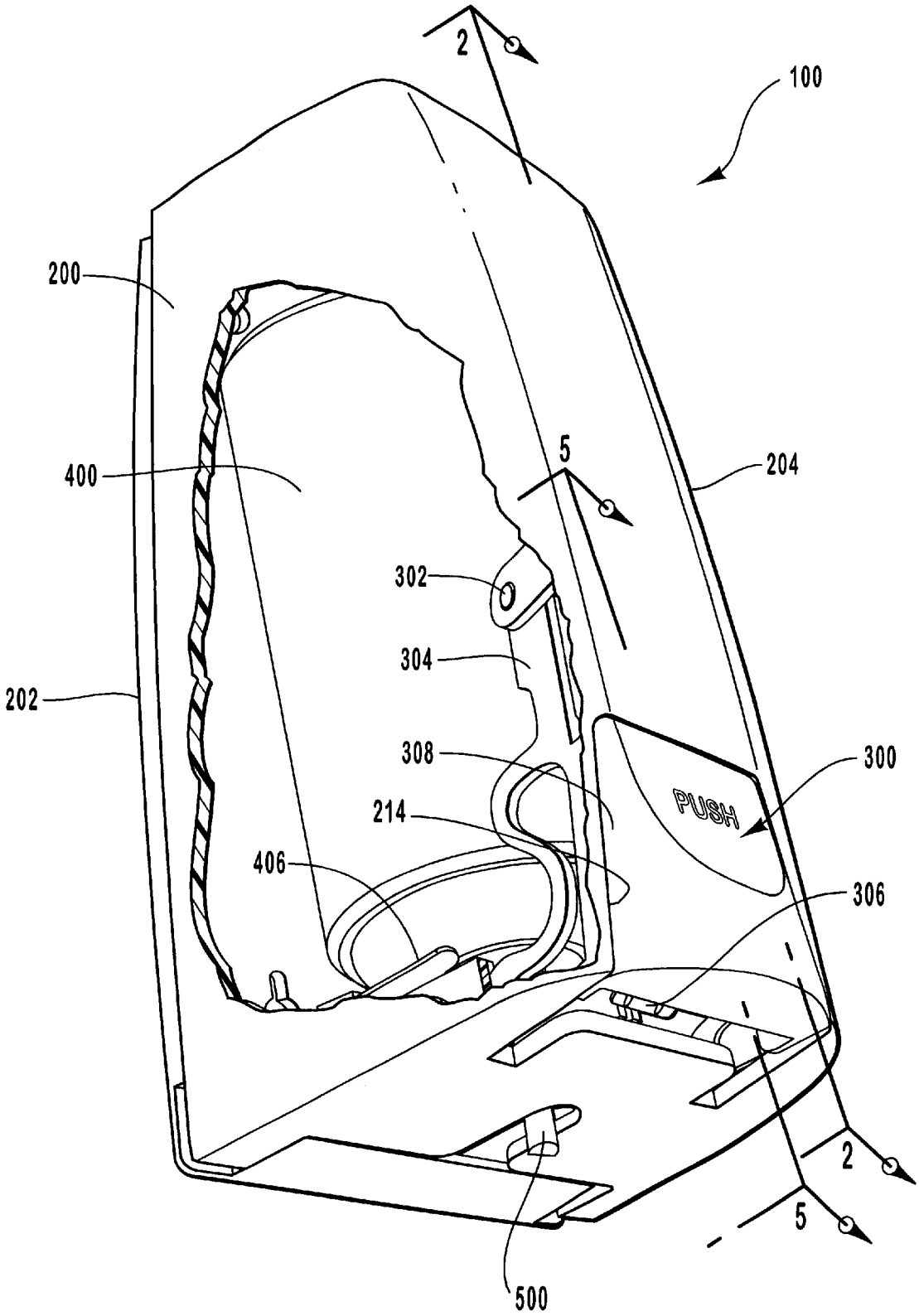
FIG. 1 is a front view of the aerosol dispensing device from the perspective of a user.

Reference is first made to FIG. 1, which depicts several major components of an embodiment of the aerosol dispensing device, each of which will be discussed in greater detail below. The aerosol dispensing device is generally indicated at 100 and includes a housing, indicated generally at 200, and a pushbutton 300. An aerosol container, indicated at 400, is fitted inside the housing 200. In a preferred embodiment, the housing 200 is mounted to a wall or the like.

Figure 2:
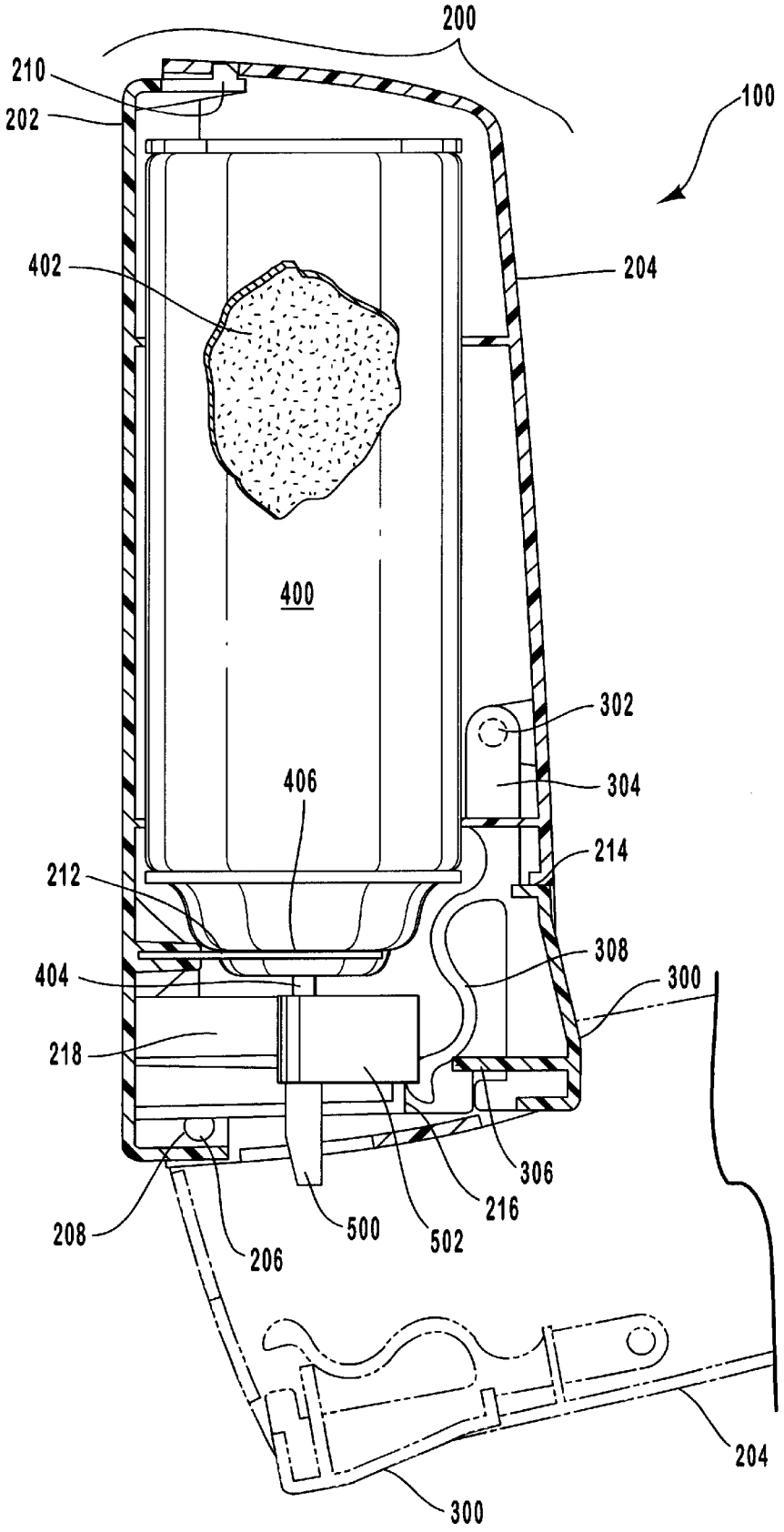
FIG. 2 is a vertical section taken through the aerosol dispensing device.

Attention is directed now to FIG. 2 which depicts the aerosol dispensing device 100 in greater detail. As indicated in FIG. 2, the housing 200 of the aerosol dispensing device 100 includes a support base 202 to which the cover 204 is attached. The cover 204 includes two integral support shafts 206 that are rotatingly received in respective support holes 208 formed in the support base 202. The integral support shafts 206 cooperate with the support holes 208 so as to permit the cover 204 to rotate with respect to the support base 202. A latch mechanism 210, or the like, acts to lock the cover 204 to the support base 202 until such time as it is desired to open the cover 204 so as to access the interior of the housing 200; the latch mechanism 210 is preferably located at the top of the housing 200.

As indicated in FIG. 2, the support base 202 has a generally rectangular shape. A support arm 212, which is substantially U-shaped in a plan view (see FIG. 3), is installed on the lower inside surface of the support base 202. Fitted into the support base 202, in a manner described in greater detail below, is the aerosol container 400 containing an agent 402 under pressure. The agent 402 preferably comprises a disinfectant or the like and is held in the aerosol container 400 at greater than atmospheric pressure. The aerosol container 400 is fitted with a discharge valve (not shown) having a hollow stem 404. In a preferred embodiment, the discharge valve is normally shut and is opened when the hollow stem 404 is tilted to one side. Tilting of the stem 404 so as to open the discharge valve is preferably accomplished by means of an actuation force applied or transferred to the hollow stem 404 in a substantially lateral direction with respect to the hollow stem 404. In a preferred embodiment, the discharge valve includes a restoration means to return the hollow stem 404 to the shut position when the actuation force is removed.

With continued reference to FIG. 2, the aerosol container 400 is inverted and a portion of a ring-form groove 406 located at the end of the aerosol container 400 near the hollow stem 404 is removably received by the support arm 212 of the support base 202, thereby securing the aerosol container 400 to the support base 202 in a "stem-down" orientation. In an alternative embodiment, the aerosol container 400 is installed in a "stem-up" orientation. In the preferred embodiment, a supplemental nozzle 500 is removably received by the hollow stem 404. The supplemental nozzle 500 is formed with a bore formed therethrough, that can be slid over the outer surface of the hollow stem 404 so as to form a continuous discharge flow path through the supplemental nozzle 500 and stem 404. Thus, when the discharge valve is open, the agent 402 will exit the aerosol container 400, pass through the hollow stem 404, and enter the supplemental nozzle 500 before finally exiting into the atmosphere. In a preferred embodiment, the nozzle 500 can be formed with an angle, so that agent 402 can be dispersed in a more convenient direction for receipt by the user. As further indicated in FIG. 2, the supplemental nozzle 500 includes an extender projection 502 extending laterally from the upper end of the supplemental nozzle 500 towards the pushbutton 300. In a preferred embodiment the extender projection 502 and the supplemental nozzle 500 are integrally formed of plastic or the like.

Figure 3:
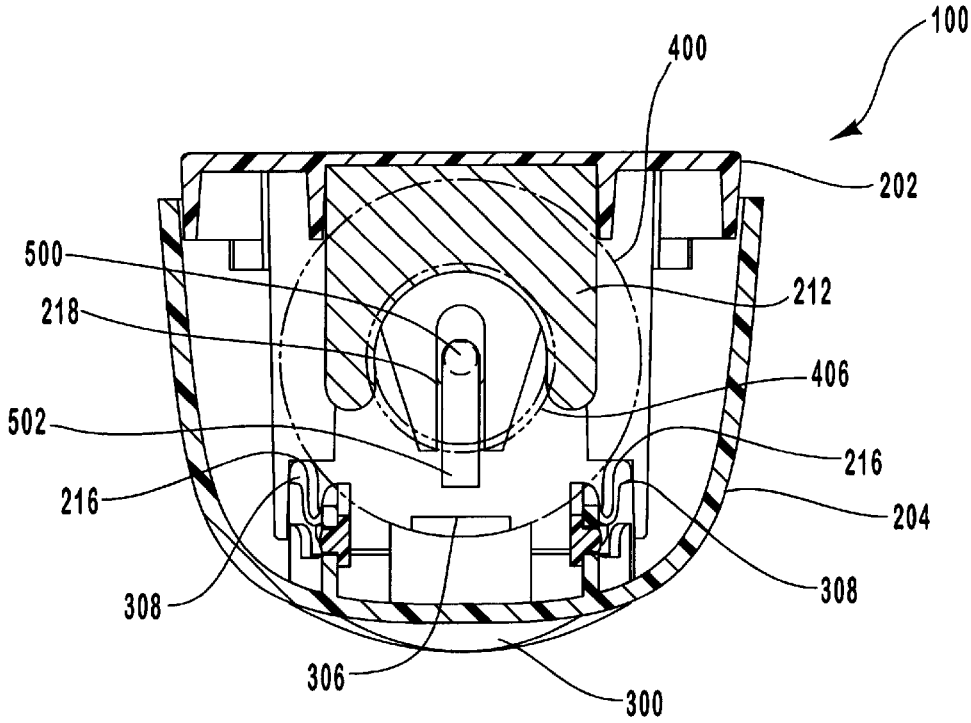
FIG. 3 is a horizontal section taken along cut line A–B–C–D indicated in FIG. 2.

As indicated in FIGS. 2 and 3, the pushbutton 300 is mounted in operative relation with the supplemental nozzle 500 and the extender projection 502. In particular, the pushbutton 300 is suspended in a cut-out area 214 in the cover 204 and secured to the cover 204 by means of pins 302 attached to suspension arms 304 joined with the pushbutton 300. The clearance between the pushbutton 300 and the cut-out area 214 permit the pushbutton 300 to rotate with respect to the cover 204 about pins 302.

Figure 4:
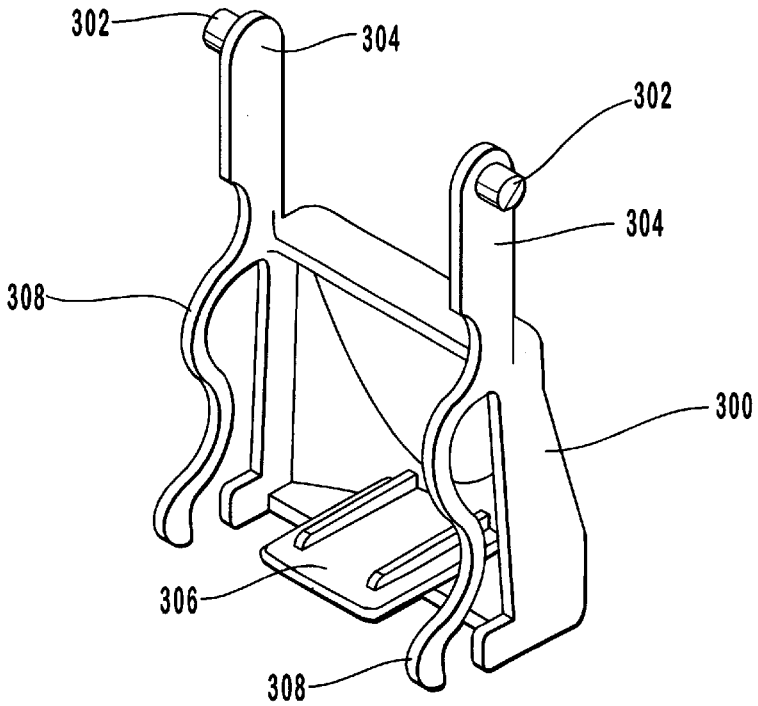
FIG. 4 is a perspective detail of the integral actuation and restoration mechanisms of the pushbutton.
Figure 5:
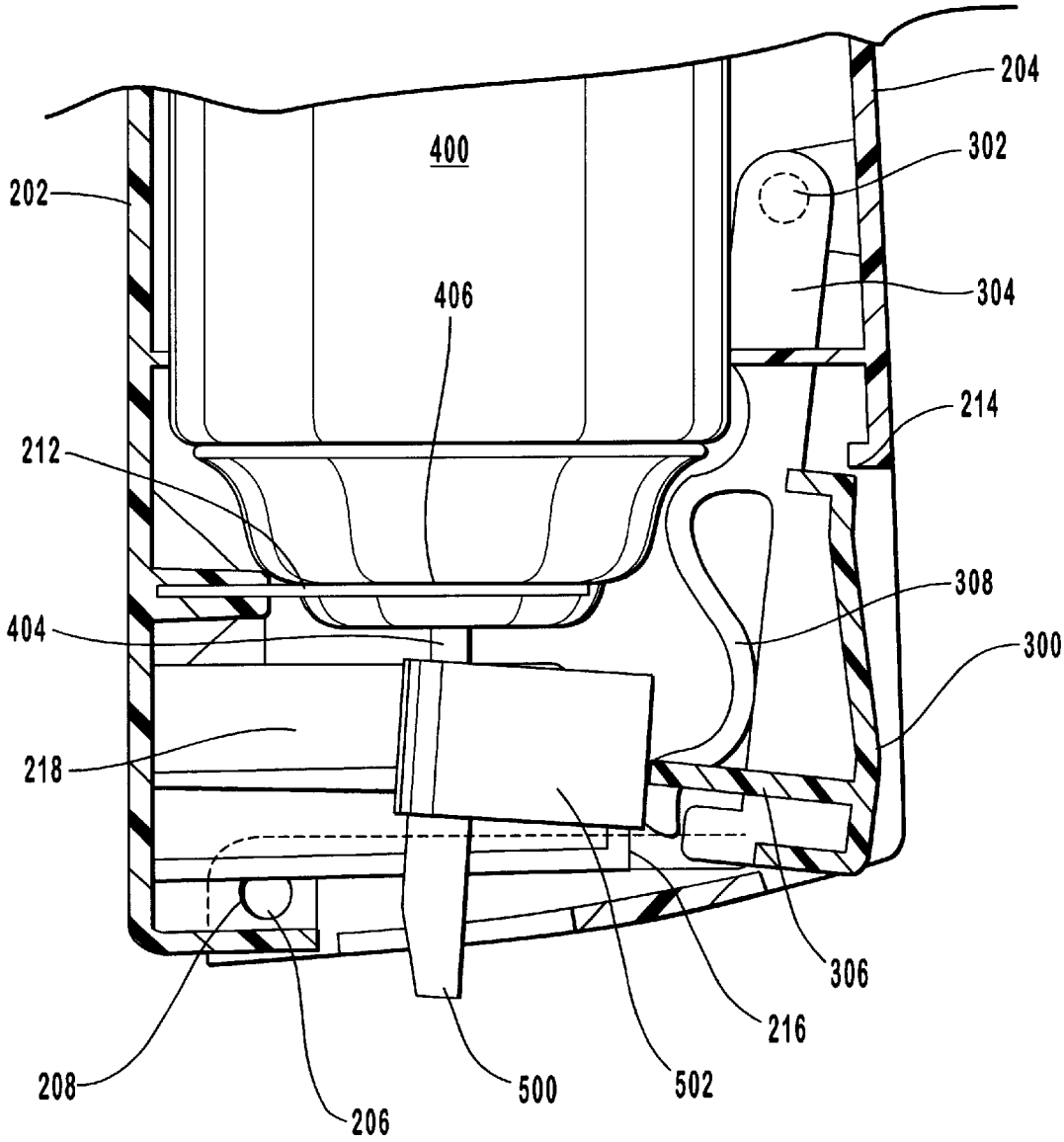
FIG. 5 is a partial vertical section view of the aerosol dispensing device showing the pushbutton in the depressed position.

Reference is next made to FIGS. 4 and 5, which together illustrate how an actuator 306 is joined to the pushbutton 300 and is oriented so as to protrude inwardly towards the extender projection 502 of the supplemental nozzle 500. Preferably, the actuator 306 is formed as an integral piece with the pushbutton 300.

Figure 6:
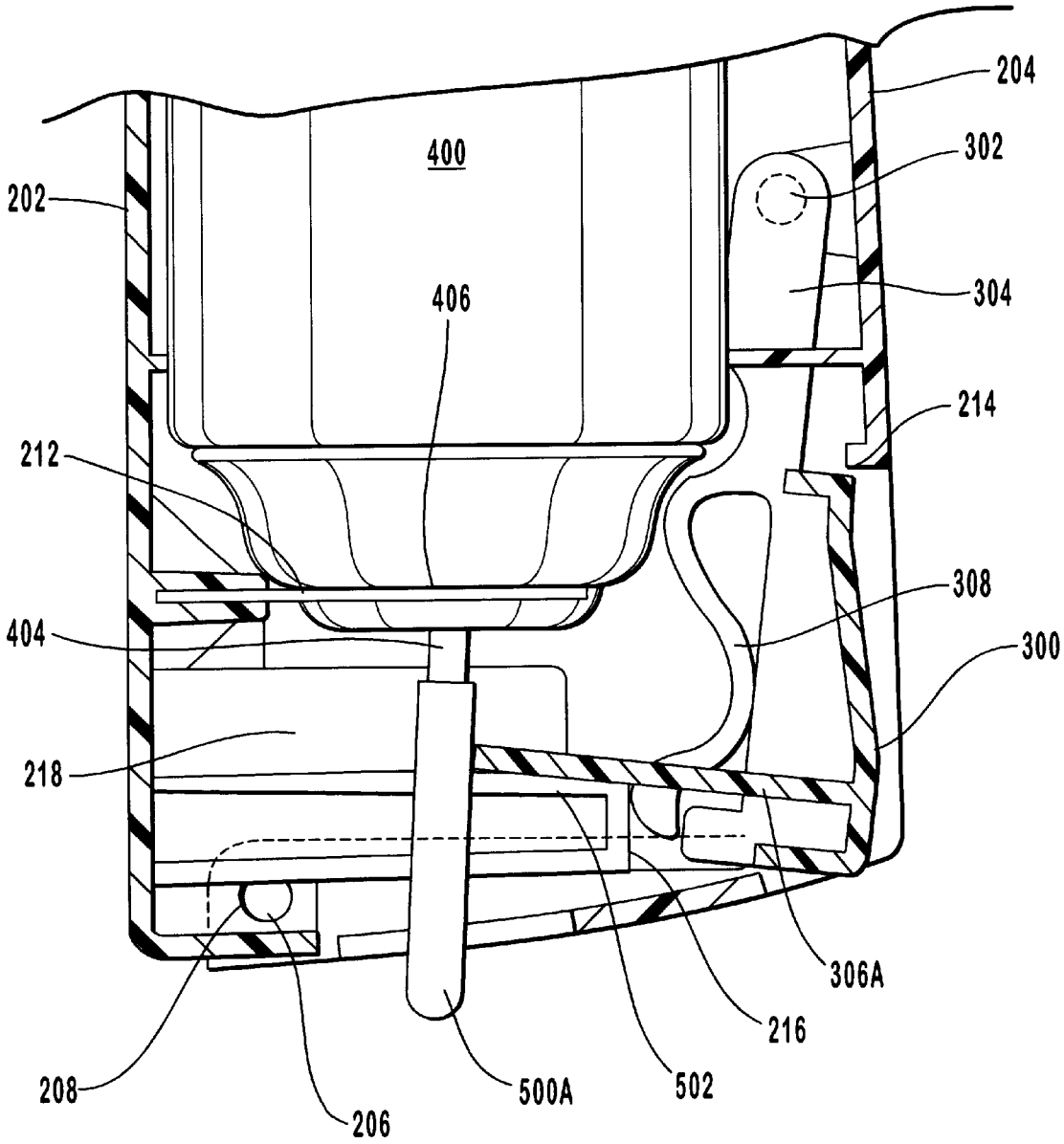
FIG. 6 is a partial vertical section view of an alternative embodiment of the present invention.

In alternative embodiment depicted in FIG. 6, the supplemental nozzle 500A lacks an extender projection. In this embodiment, the actuator 306A is lengthened accordingly so as to ensure operative contact between it and the supplemental nozzle 500A when an actuating force is applied to the pushbutton 300.

Referring again to FIG. 4, two resilient members 308 are joined to the suspension arms 304 of the pushbutton 300. By way of example, the resilient members 308 comprise "S" shaped springs and are integral with the pushbutton 300 and the actuator 306. However, this invention also contemplates as within its scope any resilient members which would perform according to the teachings of this invention, including, but not limited to, metal springs and the like. In a preferred embodiment, the pushbutton 300, the pins 302, the suspension arms 304, the actuator 306, and the resilient members 308 form an integral assembly composed of synthetic resin or the like. As is shown in FIG. 2, when the cover 204 is latched to the support base 202 and the pushbutton 300 is in a resting position, i.e., when no actuating force is being applied thereto, the resilient members 308 rest, substantially undeformed, against the bearing surfaces 216 integrally formed with the support base 202. Concurrently, the extender projection 502 reposes in a first position and is not laterally displaced against the discharge valve of the aerosol container 400, which remains closed. In their resting position, the resilient members 308 are arranged so that an actuating force applied to the pushbutton 300 will substantially compress the resilient members 308 which then exert a spring force that tends to oppose movement of the pushbutton 300 and actuator 306 towards the extender projection 502.

When an actuating force is applied to the pushbutton 300 by a user, the lower portion of the pushbutton 300 and the actuator 306 joined thereto rotate towards the extender projection 502. As the actuator 306 moves forward, it contacts the extender projection 502 and displaces the extender projection 502 laterally to a second position. As noted, the actuating force acts to substantially compress the resilient members 308 against the bearing surfaces 216 (see FIG. 5). Because the extender projection 502 is operably joined to the supplemental nozzle 500 mounted about the hollow stem 404, the lateral displacement of the extender projection 502 tilts the hollow stem 404, thereby opening the discharge valve and permitting the agent 402 to flow from the aerosol container 400 through the hollow stem 404 of the discharge valve and out through the supplemental nozzle 500. The supplemental nozzle 500 can be configured in any desired manner to control the direction in which the discharged agent 402 is sprayed.

When the actuating force ceases to be applied to the pushbutton 300, the spring force exerted by the compressed resilient members 308 automatically moves the actuator 306 away from the extender projection 502, thus allowing the discharge valve of the aerosol container 400 to automatically return the hollow stem 404 to the closed position. In a preferred embodiment, the support base 202 includes an integral nozzle guide 218 to constrain the supplemental nozzle 500, and thus the hollow stem 404 to which the supplemental nozzle 500 is mounted, to a predetermined direction and range of motion. Preferably, the predetermined direction of motion is substantially lateral.

When the agent 402 has been entirely exhausted from the container 400, as by repetitive performance of the operational steps outlined above, removal and replacement of the container 400 is easily effectuated by disengaging the latch mechanism 210 and rotating the cover 204 downwards about integral support shafts 206 sufficiently far as to enable easy access to the aerosol container 400. The aerosol container 400 can then be firmly grasped and slid outwards so that the ring-form groove 406 of the container 400 slidingly disengages from the support arm 212.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An aerosol dispensing device comprising:

(a) an enclosure having a cover rotatably attached to a support base;

(b) a container removably received by the support base, the container holding an agent under pressure that is releasable through a discharge valve;

(c) an extender projection operably attached to the discharge valve;

(d) a movable actuator that is capable of displacing the extender projection so as to open the discharge valve in response to an actuating force applied to the actuator, whereby the agent is discharged from the container through the discharge valve when the discharge valve is open; and (e) at least one resilient member that exerts a force that moves the moveable actuator into a closed position when the actuating force is removed, the at least one resilient member comprising a plurality of "S" shaped springs.

2. The dispensing device according to claim 1, wherein said agent comprises a disinfectant in aerosol form.

3. The dispensing device according to claim 1, wherein said extender projection is mounted to a hollow stem of the discharge valve, wherein movement of the extender projection displaces the hollow stem so as to open the discharge valve.

4. The dispensing device according to claim 1, wherein the support base is capable of being secured to a vertical surface.

5. The dispensing device according to claim 1, further comprising a pushbutton formed integral with said actuator, wherein said actuating force is applied to said pushbutton.

6. The dispensing device according to claim 5, wherein said actuator, said pushbutton, and said at least one resilient member are composed of synthetic resin.

7. An actuation system for use in selectively dispensing a pressurized agent from a container, said actuation system comprising:

(a) an extender projection in operative relation with a discharge valve connected to said container, said extender projection normally reposing in a first position wherein said discharge valve is closed;

(b) a pushbutton having an actuator integral therewith, said actuator moving said extender projection to a second position, so that said extender projection opens said discharge valve, in response to an actuating force applied to said pushbutton, said pressurized agent being released from said container when said discharge valve is open; and (c) a restoration mechanism integral with said actuator, said restoration mechanism automatically causing said extender projection to return to said first position when application of said actuating force has ceased, the restoration mechanism comprising at least one resilient member that comprises an "S" shaped spring.

8. The actuation system according to claim 7, wherein said pressurized agent comprises a disinfectant in aerosol form.

9. The actuation system according to claim 7, wherein said extender projection is mounted at least indirectly to said discharge valve.

10. The actuation system according to claim 7, wherein said discharge valve comprises a restoration means, said restoration means automatically restoring said valve stem to an untilted orientation when said extender projection has returned to said first position.

11. An aerosol dispensing device, comprising:

(a) a discharge valve having a hollow stem, said discharge valve being mounted in an aerosol container, said discharge valve being normally closed, and a pressurized agent being discharged from said aerosol container when said hollow stem of said discharge valve is laterally displaced; and (b) integral means for selectively discharging a pressurized agent from said aerosol container, said integral means comprising:

(a) a pushbutton;

(b) an actuator in operative relation to said hollow stem; and (c) at least one resilient member comprising an "S" shaped spring, wherein an actuating force applied to said pushbutton moves said actuator so that the actuator at least indirectly causes a lateral displacement of said hollow stem, said at least one resilient member automatically restoring said pushbutton to a non-depressed position when application of said actuating force has ceased.

12. The aerosol dispensing device according to claim 11, wherein said pressurized agent comprises a disinfectant in aerosol form.

13. The aerosol dispensing device according to claim 11, wherein said integral means is composed of synthetic resin.

14. The aerosol dispensing device according to claim 11, further comprising a supplemental nozzle integral with an extender projection, said supplemental nozzle being mounted about said hollow stem, and said extender projection being in operative relation with said actuator, so that said actuating force is transferred from said actuator to said hollow stem via said extender projection.

* * * * *